US006126107A

United States Patent [19]

Kohlen

[11] Patent Number: 6,126,107

[45] Date of Patent: Oct. 3, 2000

[54] YARN MANIPULATING DEVICE FOR TEXTILE PACKAGES

[75] Inventor: Helmut Kohlen, Erkelenz, Germany

[73] Assignee: W. Schlafhorst AG & Co., Germany

[21] Appl. No.: 09/294,522

[22] Filed: Apr. 20, 1999

[30] Foreign Application Priority Data

Jun. 4, 1998 [DE] Germany ..... 198 24 909

[51] Int. Cl.[7] ..... B65H 54/22

[52] U.S. Cl. ..... 242/476

[58] Field of Search ..... 242/475.8, 475.6, 242/476.6, 476

[56] References Cited

U.S. PATENT DOCUMENTS

| | | | |
|---|---|---|---|
| 3,406,920 | 10/1968 | Kamp | 242/476 |
| 3,559,904 | 2/1971 | Raasch . | |
| 4,009,840 | 3/1977 | Muller | 242/476 |
| 4,681,271 | 7/1987 | Matsui et al. . | |
| 4,909,451 | 3/1990 | Kuepper et al. . | |
| 4,911,371 | 3/1990 | Mista . | |
| 4,921,179 | 5/1990 | Surkamp et al. . | |
| 5,104,052 | 4/1992 | Wey et al. . | |
| 5,106,027 | 4/1992 | Wirtz et al. . | |
| 5,687,461 | 11/1997 | Kohlen . | |
| 5,871,168 | 2/1999 | Ruskens et al. | 242/475.6 X |
| 5,918,828 | 7/1999 | Fabelje et al. | 242/475.8 |

FOREIGN PATENT DOCUMENTS

| | | |
|---|---|---|
| 39 25 861 A1 | 2/1991 | Germany . |
| 40 09 702 A1 | 10/1991 | Germany . |
| 195 19 827 A1 | 12/1996 | Germany . |

*Primary Examiner*—Donald P. Walsh
*Assistant Examiner*—Collin A. Webb
*Attorney, Agent, or Firm*—Kennedy Covington Lobdell & Hickman

[57] ABSTRACT

A yarn manipulating device for textile packages, e.g., a preparation device (17) for loosening and placing the yarn end (30) of a spinning cop (16) in preparation for use as the feeding bobbin in a winding machine, comprises pneumatic yarn-end receiving member (18) connected via a suction line (23) to a housing (31) which contains an air aperture (33) and a yarn separating device (32) and therefrom to the vacuum system of a textile machine, preferably to a waste collector (24). The suction line (23) connecting the yarn-end receiving member (18) to the housing comprises an end (34) which extends inwardly past the front housing wall (35), as viewed in the direction of flow R of the suction air (36). When suction air (36) is flowing through the housing (31) to aspirate a yarn end, an area of air turbulence (40) forms in the lateral area surrounding the tubular connecting portion (34) which reliably prevents yarn fluff from settling inside the housing (31) and on the operating elements therein and thereby to avoid adversely influencing their operability.

5 Claims, 3 Drawing Sheets

YARN MANIPULATING DEVICE FOR TEXTILE PACKAGES

BACKGROUND OF THE INVENTION

The invention is relative to a device for manipulating a yarn end of a textile package for preparation thereof for unwinding, and more particularly to a the yarn manipulating device comprising a yarn-end receiving member connected to a vacuum system.

Such yarn manipulating devices are known in various embodiments in conjunction with textile machines which produce cross-wound bobbins and are explained in detail in numerous protective-right references.

German Patent Publications DE 39 25 861 A1 and DE 40 09 702 A1 describe by way of example yarn manipulating devices in the form of so-called preparation devices. The spinning cops finished on ring spinning machines connected in series are pretreated in such a manner on such preparation devices that they can be readily rewound to large-volume cross-wound bobbins subsequently at the winding heads of automatic cheese winders. The preparation devices are components of a transport system for spinning cops and empty tubes in a bobbin winding machine and have, among other things, a yarn-end loosening and receiving device, preferably in the form of a suction nozzle, connected to a waste collector. In addition, a pneumatic air blocking device and, normally, a yarn separating device are located in the area of the yarn-end loosening and receiving device.

The suction nozzle has a mouth area which is approximately adapted to the outer contour of the spinning cops and often comprises an intake slot extending over the entire length of the cop. The suction nozzle takes the yarn at first from the cop surface, cuts it to length by the yarn separating device and places it thereafter back on the cop surface or on the tip or nose of the tube in such a manner that it is disposed to be readily taken up for a subsequent work step.

The normal air requirement of these known preparation devices is not insignificant and is held within limits by an air blocking device which only connects the suction nozzle of the preparation device to the vacuum system of the textile machine if a spinning cop is ready on the preparation device.

A so-called residual cop preparation device which is comparable as regards the manner of operation is known from German Patent Publication DE 195 19 827 A1. In this residual cop preparation device the yarn-end receiving member comprises a relatively large-volume base housing connected via a vacuum line to a vacuum source. The base housing, in which a vacuum of approximately 60 to 90 mbar prevails in the operating state, comprises a vertical suction intake slot in the area of a frontal, convexly curved wall which slot has approximately the length of a spinning cop. Deflection elements are arranged on the top and/or the bottom of the housing over which elements travels a sealing belt which comprises an air passage opening with a suction nozzle connected in series. The sealing belt can be positioned in such a manner in a neutral or starting position that the intake slot is completely sealed; that is, the air passage opening is then positioned above the intake slot. The sealing belt can be lowered from this neutral position so that the suction nozzle can be brought continuously into operating positions of differing heights. A regulatable yarn separating device is also positioned here in the area of the suction-air connection of the base housing which separating device makes possible a defined cutting to length of the received yarn end.

However, a disadvantage of the known yarn manipulating devices is the fact that the operating elements arranged in a housing-like covering, preferably the air-blocking device designed as an air aperture and/or the yarn cutting device, and the areas of the housing-like covering not directly lying in the flow of suction air are very susceptible to formation of fluff or fly. Therefore, it is not uncommon that the proper functioning of the operating elements of such yarn manipulating devices is affected after a relatively short time already.

SUMMARY OF THE INVENTION

In view of the above-described state of the art, it is an object of the present invention for improving the known yarn manipulating devices.

The invention solves this problem by providing a device for manipulating a yarn end of a textile package which device basically comprises a yarn-end receiving member, a housing connected to a vacuum system, a suction line connecting the yarn-end receiving member to the housing and thereby to the vacuum system, and an air aperture arranged within the housing downstream from the yarn-end receiving member. According to the present invention, the housing having a wall and the suction line having an end connected to and extending through the wall of the housing interiorly into the housing.

This design of the housing connected into the suction line and receiving the air aperture, especially the special design of the suction line emptying into the housing with an end extending inward past the adjacent housing wall, causes the air inflowing via the suction line during the receiving of the yarn end of a textile package to form an area of air turbulence within the housing. The air flowing about in the area of air turbulence effectively prevents dust, yarn fluff or the like from being able to settle within the housing. It is assured in this manner that the operability of the operating elements arranged in the housing is not adversely affected even after a rather long operating time.

In an advantageous embodiment, the end area of the suction line is designed as a tubular connecting portion. The suction air flowing through the connecting portion into the housing allows an area of air turbulence to develop in the discharge end of the connecting portion, the circulating air currents of which area of air turbulence assure an automatic cleaning of the housing.

According to a further feature of the invention, a yarn cutting or separating device can be arranged, in addition to the air aperture, within the housing. Such a design constitutes a simple, compact and logical construction since the air circulating in the housing automatically keeps the operating elements arranged in the housing clean. An operative air aperture assures thereby that the housing can be decoupled completely pneumatically from the vacuum system of the textile machine in the time intervals located between the yarn end receiving cycles so that the consumption of air and energy of such yarn manipulating devices, which as already mentioned is not insignificant as a rule, can be held at a tolerable level. Moreover, the protected yarn separating device positioned in the immediate vicinity of the yarn-end receiving member makes possible an accurate cutting to length of the yarn end received.

In an advantageous embodiment, the yarn separating device is positioned immediately behind the tubular connecting portion of the suction line. Such an arrangement of the yarn separating device assures that the yarn end taken up from the textile package can always pass reliably into the yarn separating device uninfluenced to a very great extent by the air flows within the housing and can be exactly cut to length by the yarn separating device.

Further details, features and advantages of the invention will be described and understood from an exemplary embodiment explained below with reference to the accompanying drawings.

DESCRIPTION OF THE PREFERRED EMBODIMENT

Figure 1:
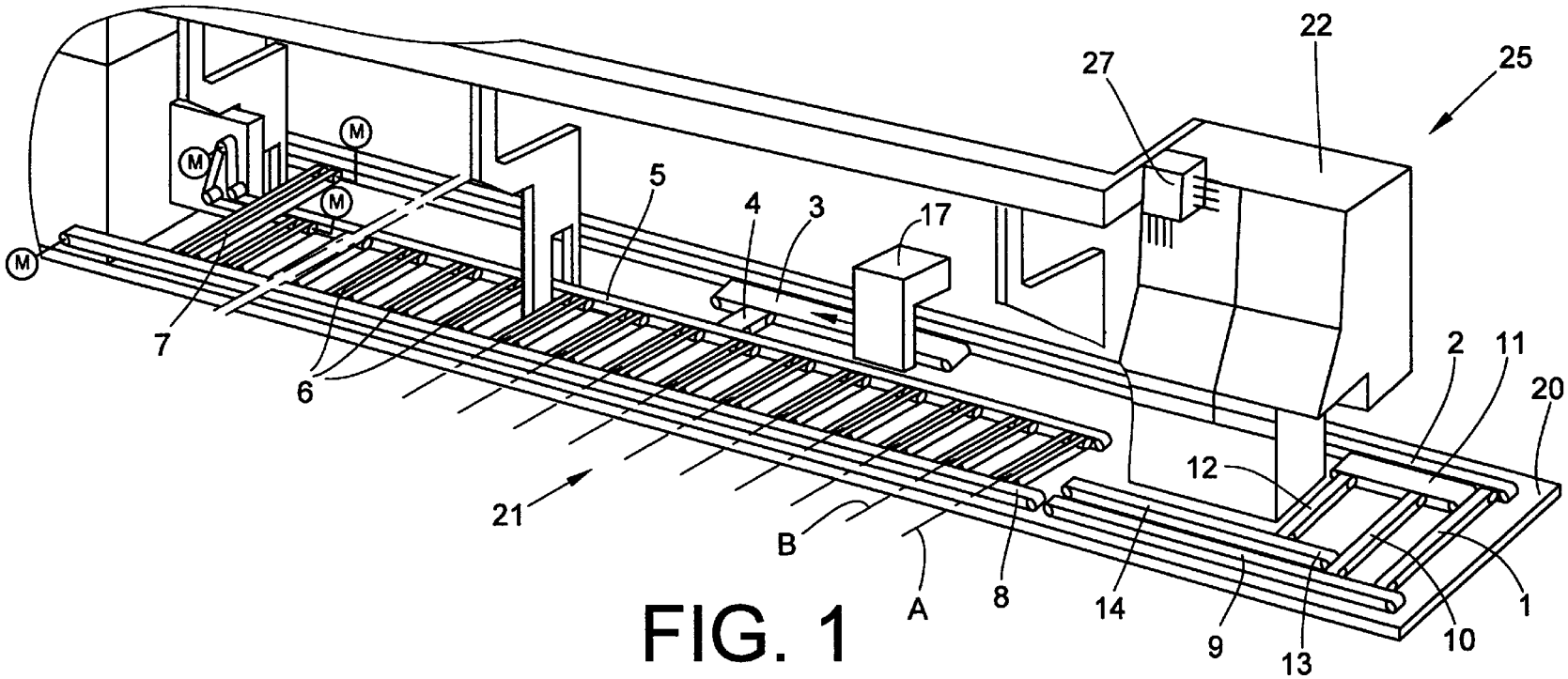
FIG. 1 is a schematic perspective view of a transport system for spinning cops and empty tubes such as known in conjunction with automatic cheese winders, and equipped with a cop preparation device having the yarn manipulating device in accordance with the invention.

Referring now to the accompanying drawings and initially to FIG. 1, a known system 21 for transporting spinning cops and empty tubes in association with an automatic cheese winder 25 is shown schematically in perspective view for the sake of clarity. The illustration of the automatic cheese winder 25 is limited essentially to energy and service unit 22 on the end side of the machine and to schematic line indications of the positions for winding heads A, B, . . . etc.

Transport system 21 for spinning cops and empty tubes is integrated into chassis 20 and basically comprises a plurality of conveyor belts defining different transport paths whose operation is briefly explained as follows.

Figure 2:
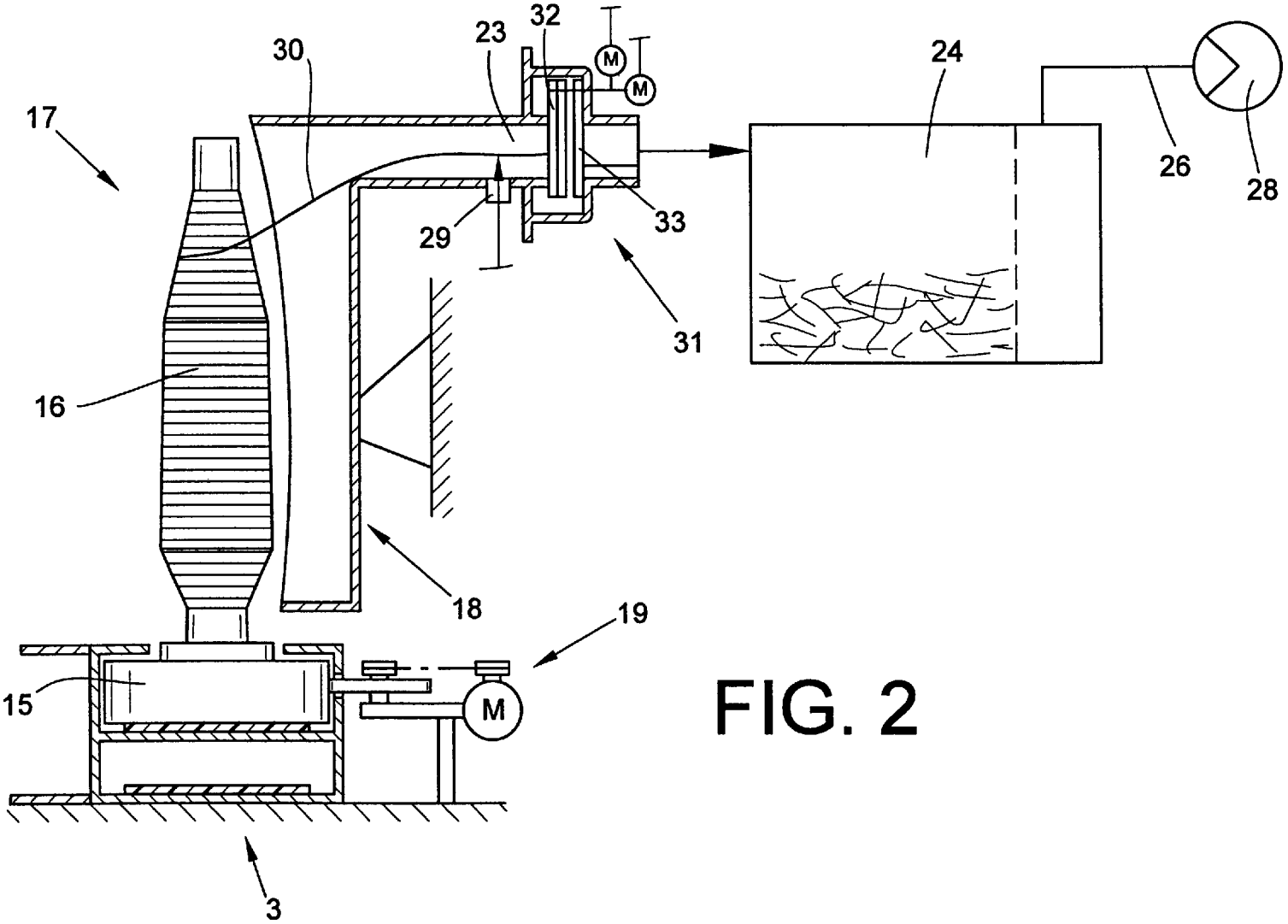
FIG. 2 is a cross-sectional view of the yarn manipulating device depicting its yarn-end receiving member connected to the vacuum system of the textile machine via a suction line and a housing which contains an air aperture and a yarn separating device.
Figure 3:
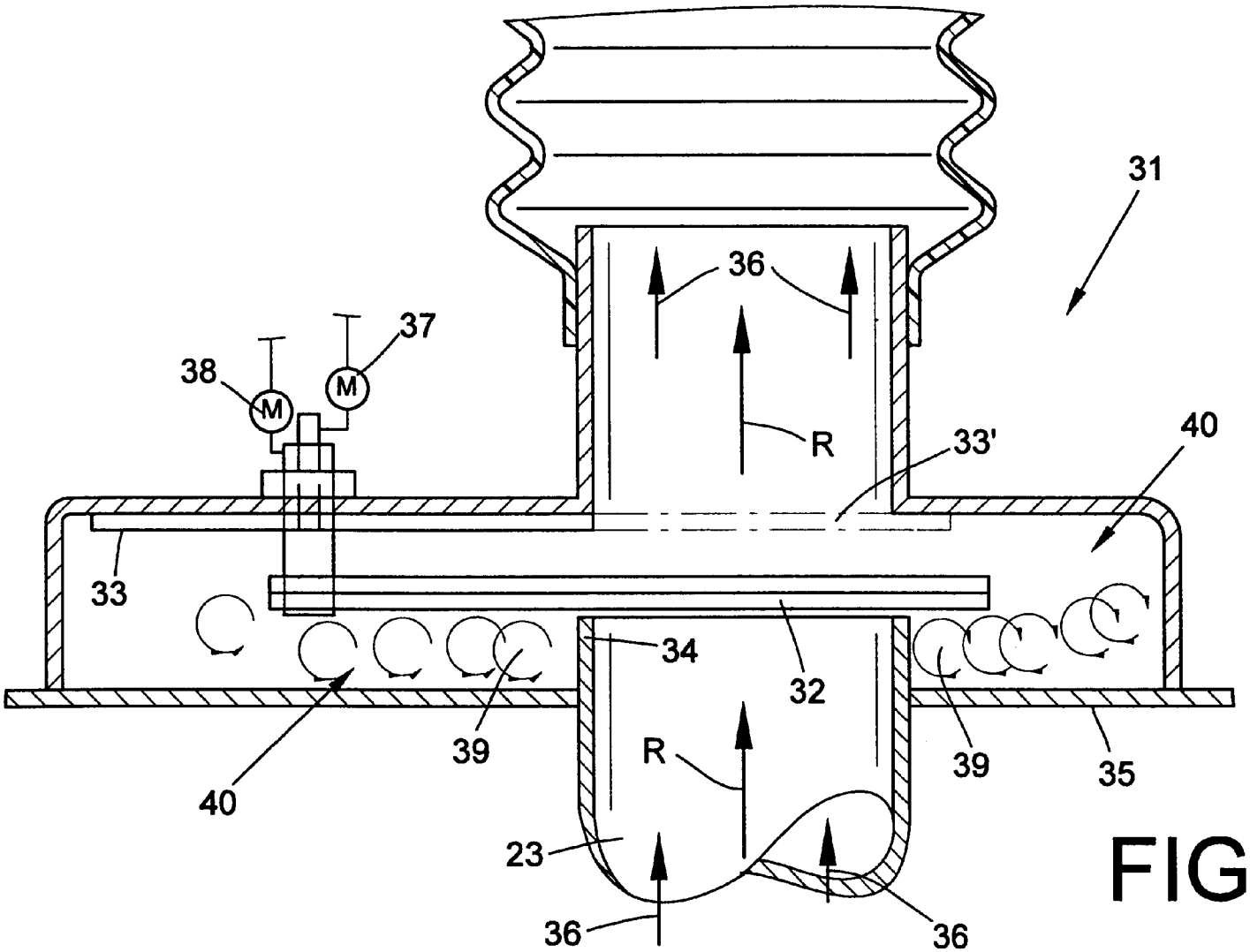
FIG. 3 is another larger scale cross-sectional view of the housing showing the end of the suction line extended into the housing as a connecting portion.

A transfer path 1 forms the intersection of present transport system 21 with the transport systems of textile machines connected in series in the production process. These serially-connected textile machines (not shown) are generally ring spinning machines. The transfer of the spinning cops finished on the ring spinning machines from the transport system of the ring spinning machines onto the transport system 21 of automatic cheese winder 25 as well as the return of unwound empty tubes from transport system 21 in a bobbin winding machine onto the transport system of the ring spinning machines take place in the area of transfer path 1 by means of a transfer device (not shown). The spinning cops set by the transfer device onto bobbin carriers in the bobbin winding machine are transported over transport path 2 running the length of the machine to one or more preparation paths 3 where the reserve winding is loosened from the spinning cops in preparation devices 17, as is known, and the spinning cops are provided with a nose winding on the tube tip which can be manipulated in the winding heads of the automatic cheese winder. The yarn manipulating device of such a preparation device 17 is shown in FIGS. 2 and 3 and described in detail below in conjunction with such Figures.

From preparation path 3 the spinning cops pass via transport removal path 4 onto cop supply path 5 which is switched alternatingly from right travel to left travel and functions as a storage path. From cop supply path 5, the spinning cops positioned on the bobbin carriers pass into the entrance area of transverse transport paths 6. These transverse transport paths 6 generally receive three spinning cops, one of which spinning cops is parked in a winding head and the two other spinning cops, likewise positioned on bobbin carriers, are parked in supply or waiting positions in front of the winding head.

Unwound empty tubes are transported from the winding heads via return path 8 and distributor path 9 back to transfer path 1 and returned therefrom, as initially indicated, by a transfer device onto the transport system of the ring spinning machines.

Spinning cops which can not be processed by preparation devices 17 arranged in the area of preparation paths 3 are fed directly via connection path 7 onto return path 8 and pass immediately as a result onto distributor path 9. A tube monitor (not shown) is arranged in the area of distributor path 9 which monitor communicates via a control line with central control unit 27 of automatic cheese winder 25. The tube monitor assures that tubes which were not completely unwound are removed via passage 10. Passage 10 is connected to residual preparation path 11, to repetition path 12 and via the latter to tube cleaning path 13 and manual preparation path 14.

FIG. 2 shows a side view of the yarn manipulating device of such a preparation device arranged in the area of preparation path 3 and with a spinning cop 16 arranged on a bobbin carrier 15. Such yarn manipulating devices generally comprise a yarn-end receiving member 18, e.g., a slot-like suction nozzle which can be placed on the surface of a spinning cop, as well as a device 19 for stopping and rotating bobbin carriers 15 in and counter to the direction of winding of spinning cops 16. Yarn-end receiving member 18 is connected via suction line 23 to waste collector 24, which for its part is connected via vacuum line 26 to vacuum source 28.

Sensor device 29, which detects the presence of a successfully aspirated yarn end 30, as well as housing 31 are connected into suction line 23 running from yarn-end receiver means 18 to waste collector 24. In addition to air aperture 33, housing 31 also contains yarn separating device 32.

Housing 31 in accordance with the invention is shown in FIG. 3 on an enlarged scale. As can be seen, end area 34 of suction line 23 is extended into housing 31; that is, the end portion of suction line 23 in the form of tubular connecting portion 34 extends inwardly past housing wall 35, which is located to the front as viewed in the direction of flow R of suction air 36. Yarn separating device 32, which can be controlled, e.g., by electric motor 38 or the like in a defined manner, is arranged immediately behind tubular connecting portion 34.

In addition, housing 31 always contains an air aperture 33 which can be controlled in a purposeful manner, e.g., by an electromotor 37, pneumatic cylinder or the like. By means of a defined control of air aperture 33, housing 31 is either connected pneumatically to the vacuum system of the textile machine, i.e., to waste collector 24 and therewith to vacuum source 28, in the open condition of the air aperture indicated in full lines in FIG. 3 or decoupled from the vacuum system of the textile machine in the closed condition of air aperture 33, as indicated in FIG. 3 in dotted lines by 33'.

Air aperture 33 and yarn separating device 32 are open for receiving the yarn end so that suction air 36 flows through housing 31 in direction R. As is indicated in FIG. 3, an area of air turbulence 40 is produced thereby on account of the design of housing 31 in accordance with the invention in the lateral area surrounding tubular connecting portion 34. Air flow 39 circulating in such area of air turbulence 40 reliably prevents dust or fluff from being able to settle in housing 31 and on the operating elements (air aperture 33, yarn separating device 32) arranged in housing 31. The automatic cleaning effect which occurs on account of this area of air turbulence 40 thus assures that the operability of the operating elements arranged in the housing is sufficiently assured even after a rather long operation.

As persons skilled in the art will recognize and understand, instead of the cop preparation device shown by way of example, the yarn manipulating device can also be used in other areas of a textile machine, e.g., on a device for grasping the yarn end on the winding or take-up side on a cross-wound bobbin. In particular, in contrast to an air aperture, a yarn separating device would not always be needed or present in such applications.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A device for aspirating a yarn end from a textile package, comprising:

(a) a vacuum source, (b) a yarn-end receiving member for directly aspirating the yarn from the textile package, (c) a housing having an interior open area to which the vacuum source is connected, and (d) a suction line connected between the yarn-end receiving member and the housing creating an airflow from the yarn-end receiving member, through the interior open area of the housing, and toward the vacuum source, (d) wherein the housing includes a wall defining a boundary of the interior open area, and an end of the suction line extends through the wall of the housing to protrude therefrom within the interior open area such that airflow exiting from the protruding end of the suction line into the interior open area creates air turbulence in an area laterally extending about the protruding end of the suction line adjacent the wall of the housing.

2. The yarn aspirating device according to claim 1, wherein the end of the suction line comprises a tubular connecting portion protruding from the wall of the housing within the interior open area.

3. The yarn aspirating device according to claim 2, wherein a yarn separating device is arranged within the interior open area of the housing.

4. The yarn aspirating device according to claim 3, wherein the yarn separating device is arranged directly downstream of the tubular connecting portion in the direction of airflow exiting from the end of the suction line.

5. The yarn aspirating device according to claim 2, wherein the tubular connecting portion has a uniform circular cross-section along its length.

* * * * *